US007978565B2

(12) United States Patent
Coffaro et al.

(10) Patent No.: US 7,978,565 B2
(45) Date of Patent: Jul. 12, 2011

(54) ALARM CLOCK WITH NAP TIMER

(75) Inventors: David Coffaro, Pittsburgh, PA (US); Zhangneng Tu, Guangzhou (CN)

(73) Assignee: New Time Products, LLC, Pittsburgh, PA (US)

( * ) Notice: Subject to any disclaimer, the term of this patent is extended or adjusted under 35 U.S.C. 154(b) by 0 days.

(21) Appl. No.: 12/796,443

(22) Filed: Jun. 8, 2010

(65) Prior Publication Data

US 2010/0309754 A1 Dec. 9, 2010

Related U.S. Application Data

(60) Provisional application No. 61/268,126, filed on Jun. 9, 2009.

(51) Int. Cl.
*G04F 10/00* (2006.01)

(52) U.S. Cl. ..... 368/109; 368/89

(58) Field of Classification Search ..... 368/89, 368/109

See application file for complete search history.

(56) References Cited

U.S. PATENT DOCUMENTS

| | | | | |
|---|---|---|---|---|
| 4,187,468 | A | 2/1980 | Kao | |
| 4,280,209 | A | 7/1981 | Mooney | |
| 4,301,524 | A | 11/1981 | Koepp et al. | |
| 4,426,736 | A | 1/1984 | Fisler | |
| 4,835,749 | A * | 5/1989 | Welton | 368/10 |
| 4,847,776 | A * | 7/1989 | Huang | 705/418 |
| 5,438,555 | A * | 8/1995 | Kim | 368/10 |
| 5,442,600 | A * | 8/1995 | Kutosky | 368/109 |
| 5,666,331 | A * | 9/1997 | Kollin | 368/245 |
| 7,317,664 | B2 * | 1/2008 | Klein | 368/107 |
| 7,463,556 | B2 * | 12/2008 | Hocherman | 368/74 |
| 7,821,873 | B2 * | 10/2010 | Carley | 368/9 |
| 7,843,770 | B2 * | 11/2010 | Orme | 368/109 |
| 2005/0058026 | A1 | 3/2005 | Hocherman | |
| 2005/0190654 | A1 | 9/2005 | Patel | |
| 2009/0213698 | A1 * | 8/2009 | Ostrovsky et al. | 368/10 |

OTHER PUBLICATIONS

Elgin Nap Timer—amazon.com/Elgin-Battery-Powered-Alarm-Silver/dp/B00026C98S; Apr. 4, 2011.*

Droid Forums—droidforums.net/forum/droid-general-discussions/14419-nap-timer-anyone.html; Apr. 4, 2011.* ipod dock—amazon.com/Sharper-Image-EC-B145-Clock-iPhone/dp/B00303G9M2/ref=sr_1_9?ie=UTF8&s=electronics&qid=1301964598&sr=1-9; Apr. 4, 2011.*

Elgin 3400E LCD Alarm Clock, http://www.4alarmclocks.com/el34lcdalcl.html.

Elgin 3408E LCD Alarm Clock, http://www.4alarmclocks.com/el34lcdalcl1.html.

* cited by examiner

*Primary Examiner* — Sean Kayes

(74) *Attorney, Agent, or Firm* — William F. Lang, IV; Lang Patent Law LLC

(57) ABSTRACT

An alarm clock includes a nap timer. At least one button may be used to add a predetermined time interval to a total nap time, while the clock is in its normal timekeeping mode. No further actions are necessary in order to set a nap time. An alarm will sound upon the elapsing of the set nap time.

8 Claims, 6 Drawing Sheets

S14 S13 S12 S11 S10 S9 S8 S7 S6 S5 S4 S3 S2 S1 C4 C3 C2 C1
S15 S16 S17 S18 S19 S20 S21 S22 S23 S24 S25 S26
PC0/S27 PC1/S28 PC2/S29 PC3/S30 PD0/S31 PD1/S32 PD2/S33 PD3/S35
PA0 PA1 PA2 PA3 PB0 PB1 PB2 PB3
VP1 VP2 CPU2 CPU1 TEST /RESET GND OSCI OSCO VCC
VDD
VCC
76

ALARM CLOCK WITH NAP TIMER

CROSS REFERENCE TO RELATED APPLICATION

This application claims the benefit of U.S. provisional patent application Ser. No. 61/268,126, filed Jun. 9, 2009, and entitled "Napper."

TECHNICAL FIELD

The present invention relates to alarm clocks. More specifically, an alarm clock having a nap timer that is quickly and easily set is provided.

BACKGROUND INFORMATION

Alarm clocks have long been used to wake people up at a desired time. A typical alarm clock is set by placing the alarm clock into an alarm time setting mode, and then setting the hour and minute at which an alarm is desired. Although this mode of setting a clock may be ideal for waking up in the morning, it is less than ideal for a nap taken during the day.

Setting the alarm for a nap would require changing the time at which the alarm clock sounds an alarm, which must then be reset back to the desired wake-up time to ensure that the alarm will sound at the correct time the following morning. Forgetting to do so could result in oversleeping. A separate nap timer, set for an amount of time rather than an alarm time, would therefore be desired to avoid the need for changing the normal wakeup time to which the clock is set. Furthermore, naps are often taken for short periods of time when an individual needs a small amount of rest, and then to get back to whatever task they may be performing. Therefore, the ability to set the clock quickly ensures that the nap may be commenced, and completed, quickly.

When traveling, it is often unclear how to set an alarm clock provided within many hotels. An individual may therefore refrain from taking a nap for fear of not waking up on time. A simple, clear way of setting a nap time is therefore desired.

A nap timer is disclosed as part of the alarm clock of U.S. Pat. No. 4,301,524, issued to R. L. Koepp et al. on Nov. 17, 1981. Setting the nap timer requires first lifting a cover to expose the controls, moving a switch to a set mode, and then pressing a "doze" button for every 10 minutes of desired mapping. This method of setting the nap timer is complicated, and an instruction manual would probably be required for an individual unfamiliar with the clock.

Accordingly, an alarm clock with a simple, obvious way to set a nap timer is needed.

SUMMARY

The above needs are met by an alarm clock having a nap timer that may be set while the clock is in its normal timekeeping mode. The alarm clock includes at least one button which, when depressed, it adds a predetermined length of time to a total nap time.

Some examples of the alarm clock may include nap time setting buttons disclosed on exterior surfaces of the alarm clock, which may be accessed without the need to open any covers. Other examples may include multiple nap time setting buttons, each of which is structured to add a different predetermined time to the total nap time. Still other examples may include a separate nap time display, located on a different portion of the display than the time of day.

BRIEF DESCRIPTION OF THE DRAWINGS

Like reference characters denote like elements throughout the drawings.

DETAILED DESCRIPTION

Figure 1:
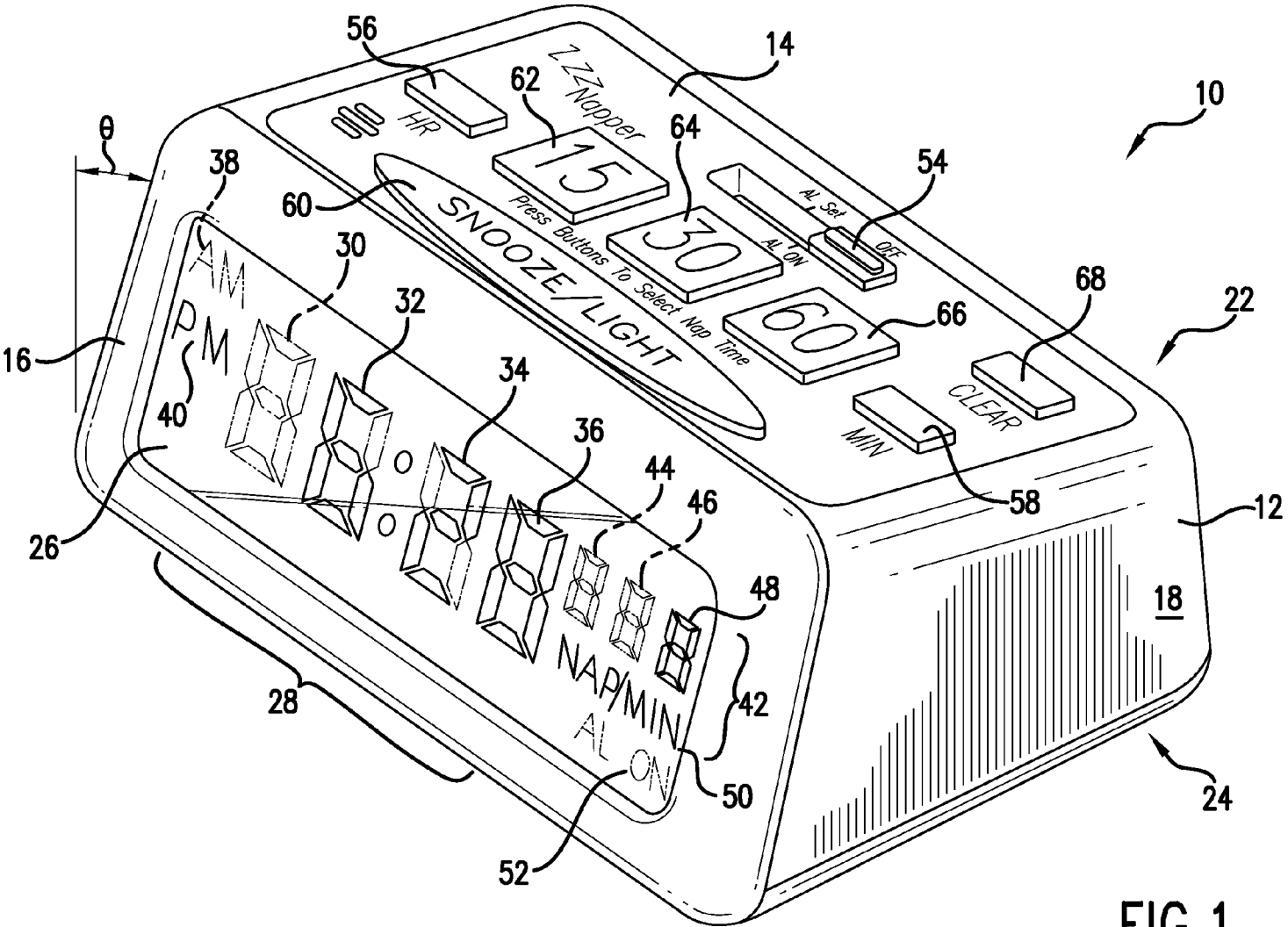
FIG. 1 is a perspective view of an alarm clock.

Referring to FIG. 1, an alarm clock 10 is illustrated. The alarm clock 10 includes a housing 12 having a top 14, a front 16, a pair of sides 18, 20, a back 22, and a bottom 24.

The front 16 includes a display 26, which in illustrated example is a liquid crystal display (LCD). Other possible displays 26 include seven segment displays composed of light emitting diodes (LEDs), or analog displays, both of which are well known in the art of clocks. The display 26 includes a time display portion 28, which in the illustrated example is in the center of the display. The time display portion 28 includes 4 seven segment displays 30, 32, 34, 36, with displays 30 and 32 configured to display an hour portion of the time, and displays 34 and 36 configured to display a minute portion of the time. The display 26 may also include AM indicator 38 and PM indicator 40, which in the illustrated example are located on the left side of the display 26. The display 26 includes a nap timer portion 42, which in the illustrated example is located to the right of the time display portion 28, and includes 3 seven segment displays 44, 46, 48, which are configured to display a nap time in minutes, as indicated by the text 50 below these seven segment displays. Lastly, the display 26 includes an alarm on indicator 52. The display 26 may be backlit in a manner well known in the art of LCD displays, and described in greater detail below. Some examples of the display 26 may be angled in order to facilitate reading the clock by individuals of varying heights, or who may be standing or seated. As shown in FIG. 1, the angle θ shown on the illustrated example display 26 is about 18° upward from vertical.

In the illustrated example of the alarm clock 10, most of the controls are disposed on the top 14 of the housing 12. A four position sliding mode switch 54 is disposed near the back of the clock 10. The mode switch 54 includes positions corresponding to time set and alarm set, in which either the time of day or the alarm time setting, respectively, may be set. The mode switch 54 further includes two other settings, alarm on and alarm off. In either of the latter two settings, neither the time of day nor the alarm time setting may be modified. For the purposes of this description, the phrase "normal timekeeping mode" shall mean that the mode switch 54 is in either the alarm on or alarm off position. Hour button 56 and minute button 58 are also disposed on the top 14. When the mode switch 54 is set to either time set or alarm set, pressing the hour or minute buttons will adjust the hour or minute portions of the time or alarm settings. A large snooze/light button 60 is disposed on the top 14. This button activates a backlight for the display 26, permitting the display to be read in the dark. If the alarm is sounding, pressing the snooze/light button 60 will deactivate the alarm, reactivating it after about 10 minutes.

At least one nap timer button is disposed on the top 14, for adding a predetermined time to a total nap time. In the illustrated example, three nap timer buttons 62, 64, 66 are provided. Depressing one of the buttons 62, 64, or 66 will add 15, 30, or 60 minutes, respectively, to the total nap time, up to a predetermined maximum nap time. Other time increments could be utilized if desired. In the illustrated example, various combinations of these buttons may be depressed to increase the total nap time up to a total of 480 minutes. A clear button 68 may be provided to reset the total nap time to zero.

Figure 2:
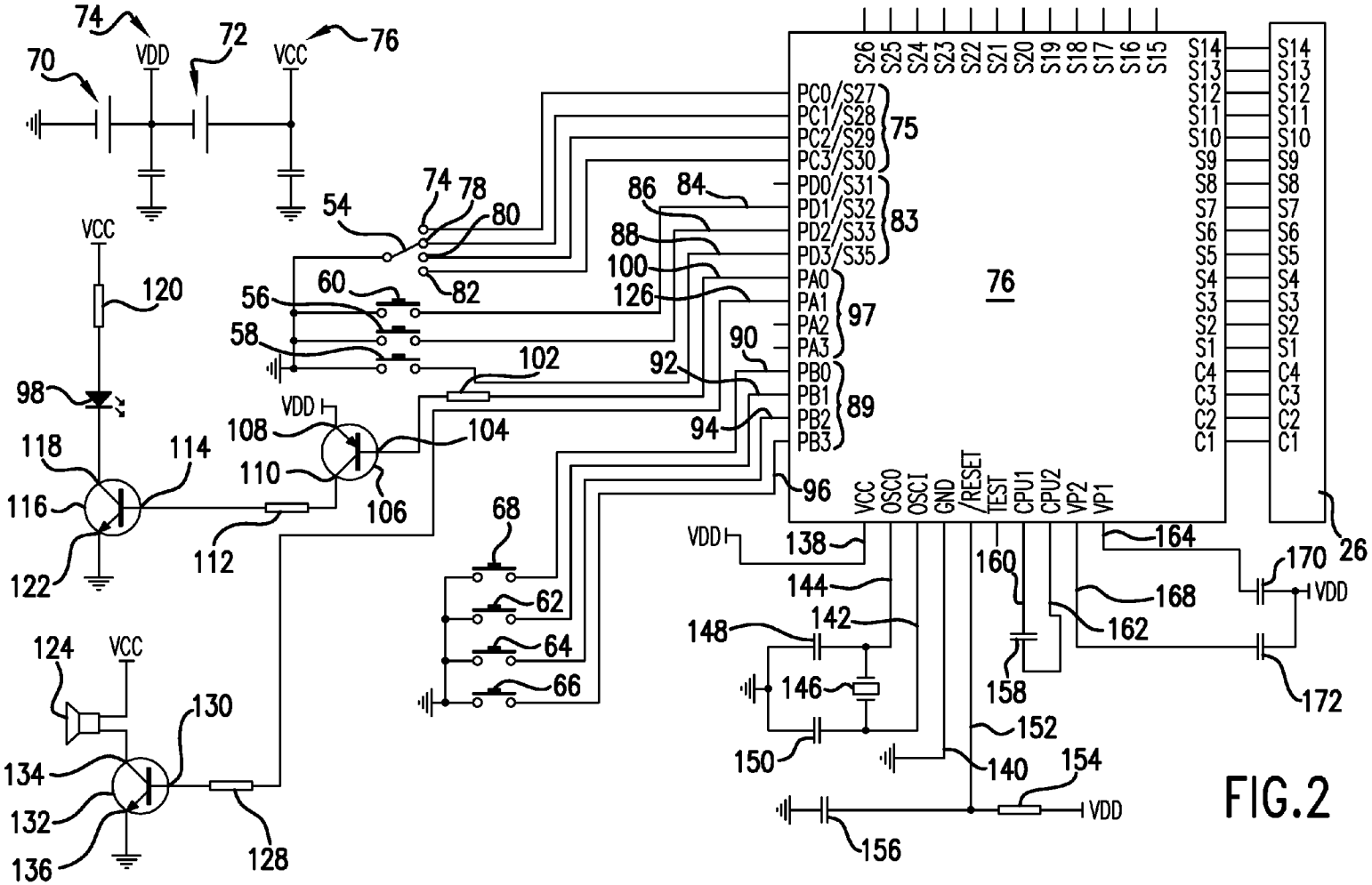
FIG. 2 is a schematic view of the components of the alarm clock of FIG. 1
Figure 3:
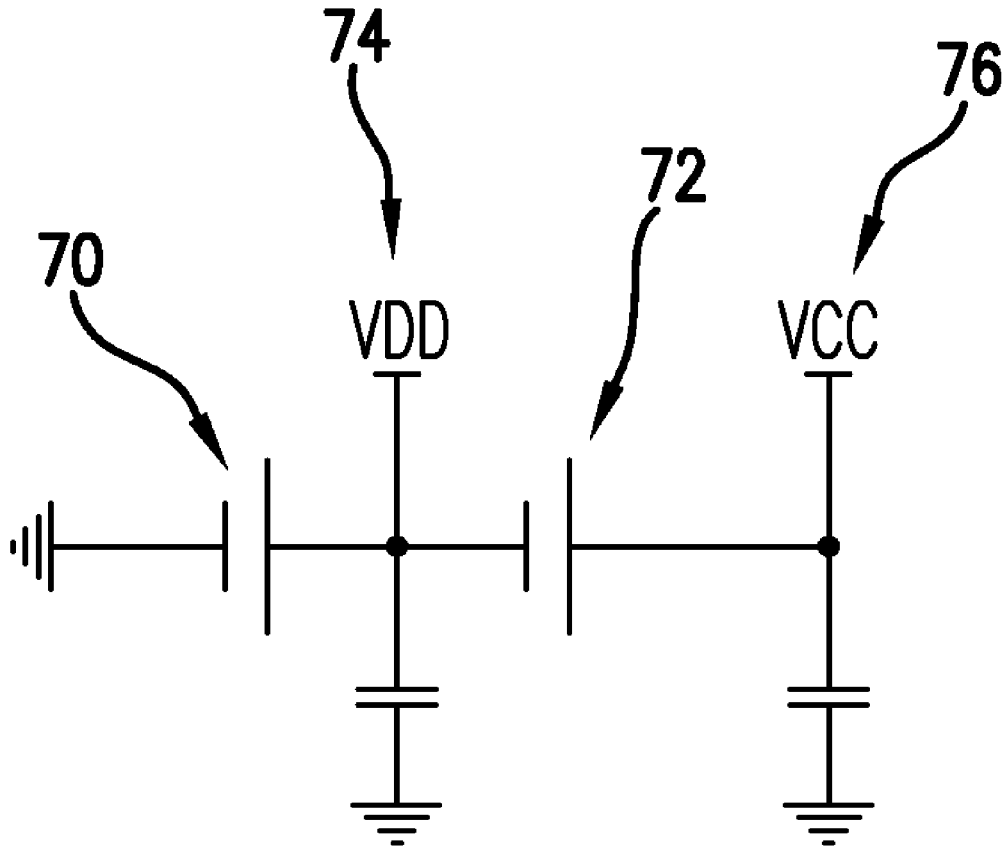
FIG. 3 is a schematic view of the power supply for the alarm clock of FIG. 1.

The various electrical components of the alarm clock 10 are illustrated in FIGS. 2-6, with FIG. 2 illustrating the overall schematic, and FIGS. 3-6 illustrating various portions of the overall schematic. Referring to FIGS. 2-3, although some embodiments of the invention may be configured for AC power, the illustrated example utilizes a power supply including a pair of batteries 70, 72. Utilizing this arrangement, 1.5 V may be derived between the batteries at location 74 (VDD), and 3 V may be derived at location 76 (VCC).

Figure 4:
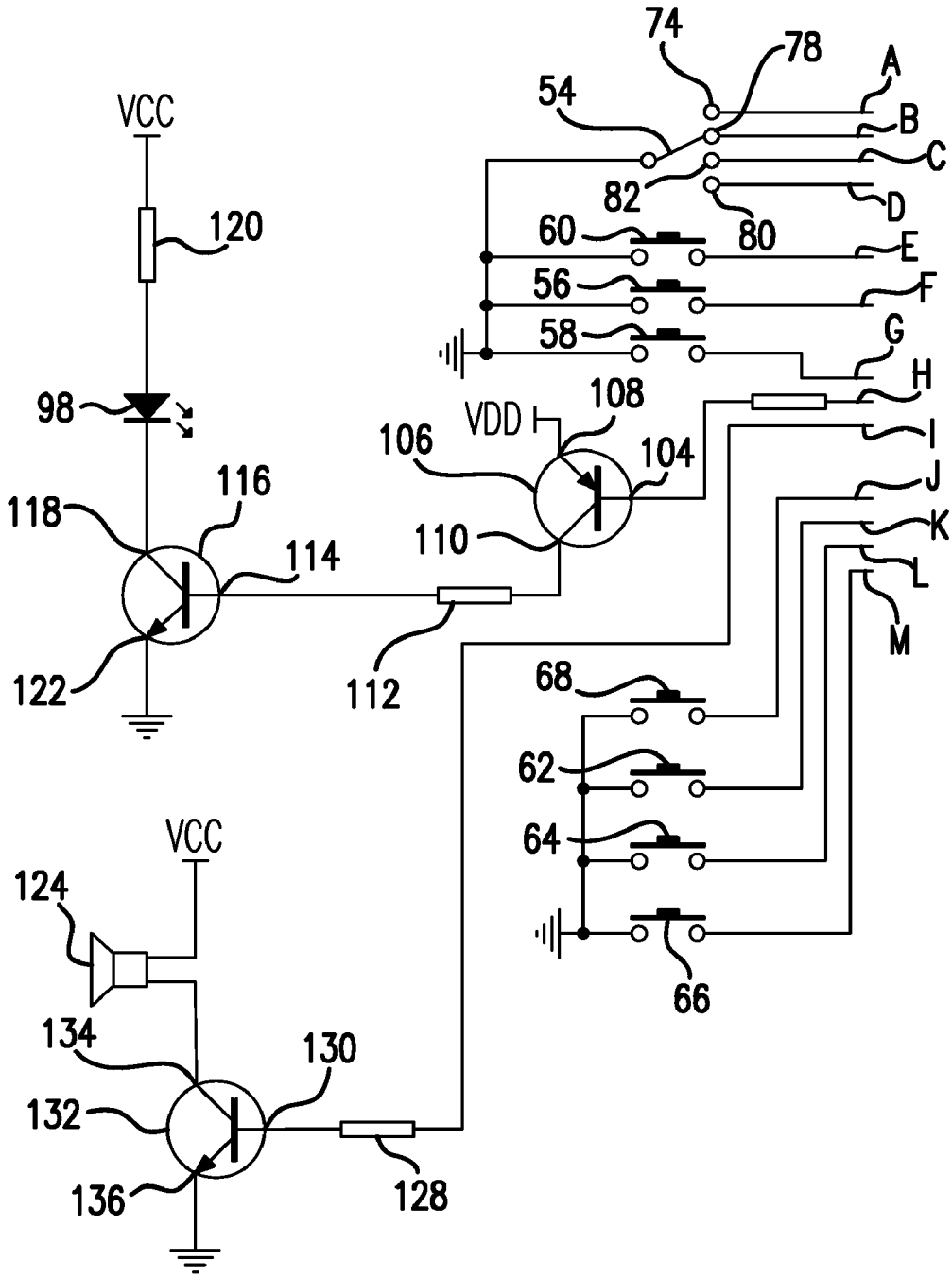
FIG. 4 is a schematic view of the controls and some outputs of the alarm clock of FIG. 1.

The majority of inputs and outputs for the alarm clock are illustrated in FIGS. 2-4. Near the upper left portion of the circuit, the four position mode switch 54 is illustrated. This switch includes connections for time set 74, connected to pin 0 off a of port C (75) of the microcontroller 76; alarm set 78, connected to pin 1 of port C; alarm on 80, connected to pin 2 of port C; and alarm off 80 connected to pin 3 of port C (75).

The snooze/light button 60, hour button 56, and minute button 58 are connected to port D (83) of the microcontroller 76, with the snooze/light button 60 being connected to pin 1 (84), the hour button 56 connected to pin 2 (86), and the minute button 58 connected to pin 3 (88). The remaining buttons are connected to port B (89) of the microcontroller 76. The clear button 68 is connected to pin 0 (90). Nap button 62, which in the illustrated example adds 15 minutes to the nap time, is connected to pin 1 (92). Nap time button 64, which in the illustrated example adds 30 minutes to the nap time, is connected to pin 2 (94). Nap time button 66, which in the illustrated example adds 60 minutes to the nap time, is connected to pin 3 (96). Ports B, C, and D are set to respond to active low signals. Therefore, the switch 54 and buttons 56, 58, 60, 62, 64, 66, and 68 are all configured to connect the appropriate pin to ground when actuated.

Two outputs are connected to port A (97) of the microcontroller 76. The back light for the display 26 is provided by the LED 98, which is controlled by the output of pin 0 (100). This output is supplied, preferably through a resister 102 which in the illustrated example is a 1 kΩ resister, to the base 104 of the PNP transistor 106. The emitter 108 of transistor 106 is connected to the 1.5 volt power source VDD. The collector 110 of transistor one of six is connected through resister 112, which in the illustrated example is a 10 kΩ resister, to the base 114 of NPN transistor 116. The collector 118 of transistor 116 is connected to the LED 98, which is connected to a 3 volt power source VCC through the resister 120, which in the illustrated example is a 27Ω resister. The emitter 122 of the transistor 118 is connected to ground. Accordingly, a signal from pin A0 (100) will supply a low voltage through transistor 106 to the base of transistor 116, thereby permitting a higher voltage to pass through and illuminate the LED 98, back lighting the display 26.

The speaker 124 for the alarm is controlled by pin 1 of port A (126). This pin is connected through the resister 128, which in the illustrated example is a 1 kΩ resister, to the base 130 of the NPN transistor 132. The collector 134 of transistor 132 is connected to the speaker 124, which is also connected to a 3 volt power source VCC. The emitter 136 of transistor 132 is connected to ground. Therefore, a signal from pin A1 (126) will supply a voltage to the base 134 of the transistor 132, providing power to the speaker 124.

Figure 5:
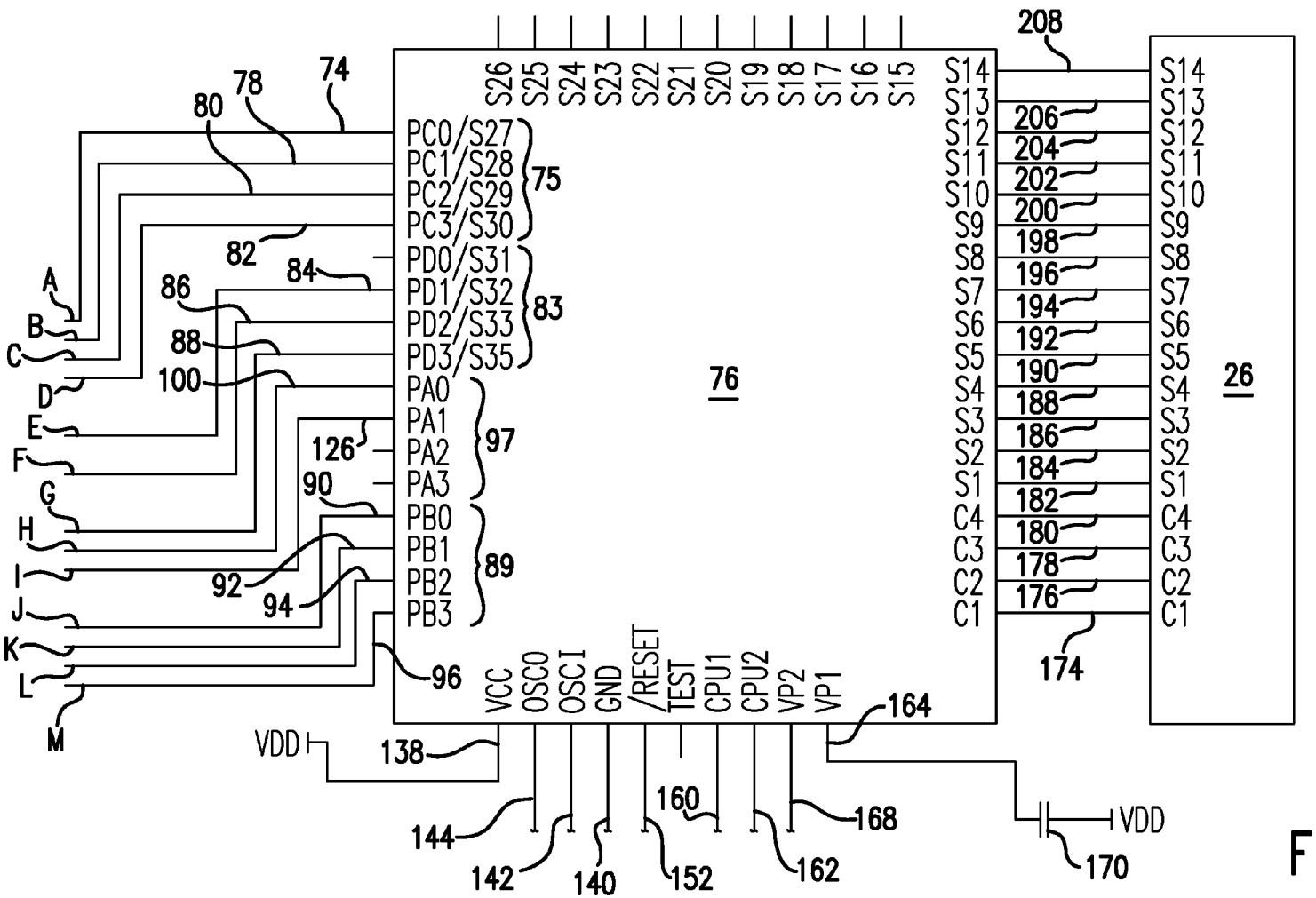
FIG. 5 is a schematic view of the microcontroller and display for the alarm clock of FIG. 1.

Microcontroller 76 is illustrated in FIGS. 2 and 5. A variety of controllers could be selected, including both general-purpose programmable microcontrollers, programmable logic devices such as field programmable gate arrays, application specific integrated circuits, and custom integrated circuits. The illustrated microcontroller 76 is a SH66L08A, manufactured by Sino Wealth in Shanghai, China. This microcontroller is a 4-bit microcontroller with a built-in LCD driver. It can be programmed in assembly language in a manner that is well known in the art, and is described in instruction manuals provided by the manufacturer. Ports A, B, C, and D, the utilization of which is discussed above, are bit programmable input/output ports, with port A, pin 1 being configured for possible buzzer output, and ports B and C configured to receive active low interrupt signals, making them ideal for responding to inputs from the mode switch 54, and nap timer buttons 62, 64, 66, and 68. When the hour 56, minute 58, and snooze 60 buttons are utilized, a condition which would cause the clock microcontroller 76 to expect an input from these controls would have already occurred (either through the changing of the mode switch 54 or the sounding of the alarm), eliminating the need for interrupt capability.

Figure 6:
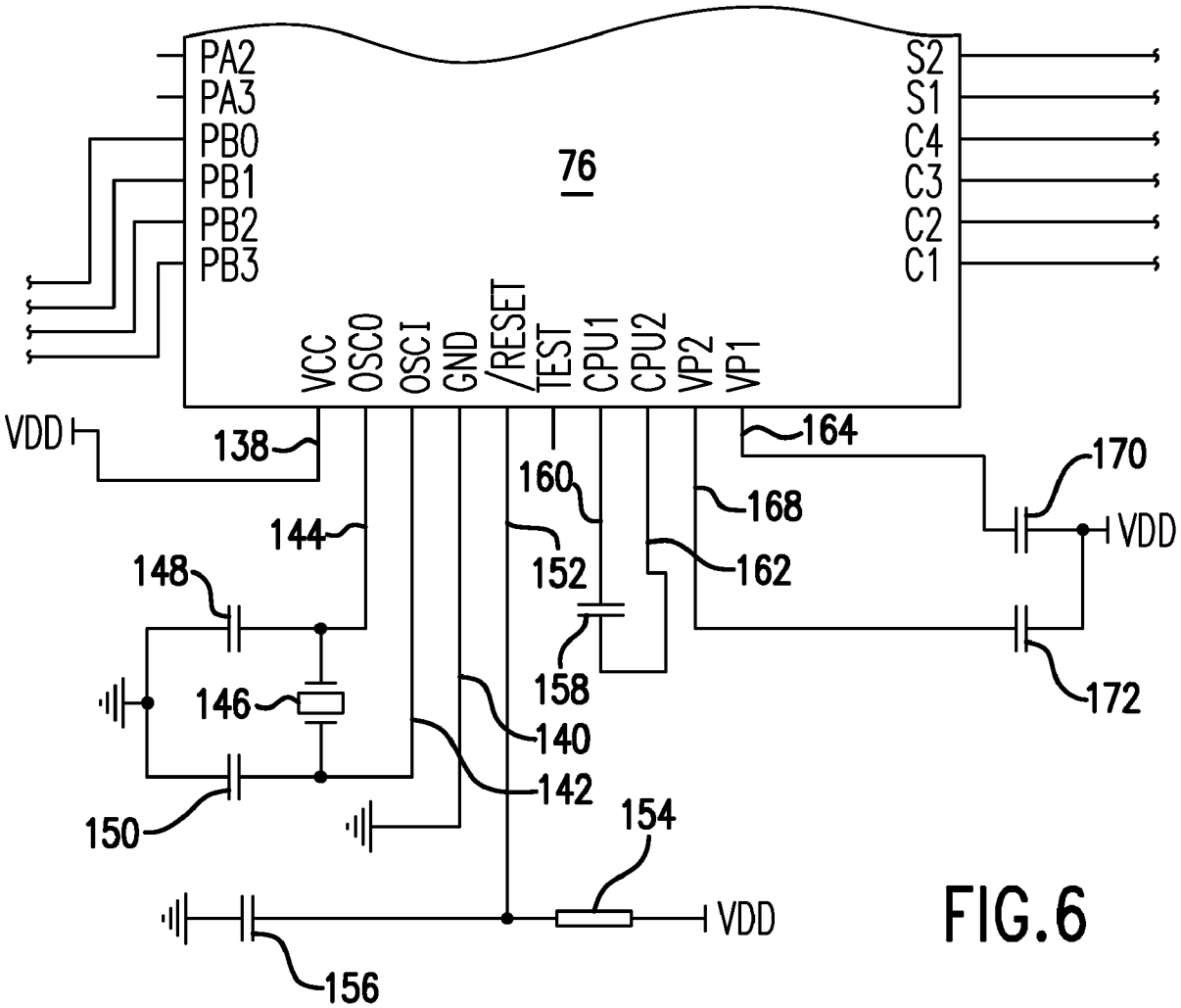
FIG. 6 is a schematic view of the microcontroller control circuitry for the alarm clock of FIG. 1.

Turning to FIGS. 5-6, other microcontroller control inputs are illustrated. The VCC pin 138 is connected to a 1.5 V power source VDD, well the ground in 140 is connected to ground, thereby supplying power to the microcontroller 76. The oscillator input pin 142 and oscillator output pin 144 are connected to an oscillator 146, which provides the necessary timing for the operation of the microcontroller 76. In the illustrated example, the oscillator 146 is a 32.768 kHz crystal oscillator that is presently available from a variety of sources. The oscillator 146 is connected through a pair of capacitors 148, 150, which in the illustrated example are 18 pF capacitors, to ground. The reset pin 152 is active low, and is therefore supplied with a high signal to resist the resetting of the microprocessor 76. To accomplish this, the reset is connected to the 1.5 V power source VDD through a resister 154, which in the illustrated example is a 47 kΩ resister, and to ground through a capacitor 156, which in the illustrated example is a 0.1 μF capacitor. A voltage doubling capacitor 158, which in the illustrated example is a 0.1 μF capacitor, is connected across the CPU1 (160) and CPU2 (162) pins. Lastly, the VP1 (164) and VP2 (166) power supply pins for the LCD driver are each connected to a 1.5 V power source through a capacitor 170 and 172, respectively, which in the illustrated example are 0.1 μF capacitors.

Referring back to FIG. 5, the connection of the microcontroller 76 with the display 26 is illustrated. As explained above, the illustrated example of the display 26 is an LCD display. The microcontroller 76 provides a common signal outputs to the display 26 through pins C1 (174), C2 (176), C3 (178), and C4 (180). Output to the individual LCD segments is provided through pins S1 (182), S2 (184), S3 (186), S4 (188), S5 (190), S6 (192), S7 (194), S8 (196), S9 (198), S10 (200), S11 (202), S12 (204), S13 (206), S14 (208).

Referring back to FIG. 1, the operation of the clock 10 can best be explained. To set the time on the clock, the mode switch 54 is placed in the time set position, wherein the hour button 56 and minute button 58 may be depressed to change the hour and minute portions, respectively of the time display portion of the display 26. To set an alarm time, the mode selection switch 54 is moved into the alarm set position, thereby causing the display 26 to display the time for which the alarm is set. As before, depressing the hour button 56 and minute button 58 permits the user to change the hour and minute portions, respectively, of the time at which an alarm is set to go off. Once the clock is set, depending on whether the user would like an alarm to sound at the selected time, the mode selection switch 54 may be placed in either the alarm on or alarm off positions. Any time the user wishes to read the clock in low light, the snooze/light button 60 may be depressed, actuating the LED 98, and illuminating the display 26. If an alarm sounds and the user would like an additional 10 minutes of sleep, the snooze/light button 60 may be depressed, causing the alarm to stop sounding, and to sound again after 10 minutes.

The operation of the nap timer is particularly simple. In order to set a nap time, the user presses the 15 minute nap time button 62, the 30 minute nap time button 64, and/or the 60 minute nap time button 66, either individually or in any combination that will result in a total nap time of the desired duration. Each press of one of the buttons 62, 64, 66 adds the time associated with that button to the total nap time. For example, a user wishing to take a 1½ hour nap would depress button 64 once, and button 66 once, for a total of 90 minutes. Similarly, a two hour nap is achieved by depressing button 66 twice. Particularly in the case of multiple nap time buttons, each associated with a different predetermined time increment, entering a wide variety of nap times may be done very quickly, without the need to repeatedly enter a short time increment until a long nap time is reached. Once a nap time has been entered, no further action on the part of the user is necessary. After the total nap time has elapsed, the alarm will sound, and depressing any button on the clock 10 will deactivate the alarm. In the event that the user enters an erroneous nap time, the clear button 68 may be depressed to restore the nap time to zero. The correct naptime may then be entered.

The alarm clock 10 therefore provides a nap timer which may be quickly and easily set by a user. A naptime of a desired duration may be entered by doing nothing more than depressing at least one nap time button, adding a predetermined time intervals of the total nap time with each press, until the desired time is reached. It is not necessary to switch the clock out of its normal timekeeping mode in order to set a naptime. The naptime is displayed on the display of the clock along with the current time. All of these features serve to make setting a naptime relatively simple and obvious for a user who may be unfamiliar with the clock.

A variety of modifications to the above-described embodiments will be apparent to those skilled in the art from this disclosure. Thus, the invention may be embodied in other specific forms without departing from the spirit or essential attributes thereof. The particular embodiments disclosed are meant to be illustrative only and not limiting as to the scope of the invention. The appended claims, rather than to the foregoing specification, should be referenced to indicate the scope of the invention.

What is claimed is:

1. An alarm clock, comprising:

a time base performing a timekeeping function in conjunction with a time display;

a user-settable alarm;

a snooze button;

a nap timer, the nap timer having at least two nap timer buttons, each of the at least two nap timer buttons, when depressed during the timekeeping function of the alarm clock, adds a different predetermined time interval to a total nap time to elapse prior to the sounding of an alarm, one of the different predetermined time intervals being an integer multiple of another predetermined time interval;

each of the snooze button and at least two nap timer buttons being larger in size than any other control of the alarm clock, except for the snooze button and nap timer buttons;

indicia indicating the duration of each of the predetermined time intervals; and wherein the nap timer begins timing the predetermined time interval in response to at least one of the two nap timer buttons being depressed, without further need to actuate any other controls.

2. The alarm clock according to claim 1, wherein the at least one nap timer button is disposed on an uncovered external surface of the alarm clock.

3. The alarm clock according to claim 1, wherein the total nap time is displayed on a nap time display portion of a display, the nap time display portion being separate from a time display or a time display portion.

4. The alarm clock according to claim 1, wherein the at least two nap timer buttons are three nap timer buttons.

5. The alarm clock according to claim 4, wherein:

a first nap timer button is structured to add about 15 minutes to a nap time;

a second nap timer button is structured to add about 30 minutes to a nap time; and a third nap timer button is structured to add about 60 minutes to a nap time.

6. The alarm clock according to claim 1, further comprising a clear button which, upon actuation, clears a currently-set nap time.

7. The alarm clock according to claim 1, further comprising a generally vertical display that is angled upward.

8. The alarm clock according to claim 7, wherein the extent to which the display is angled upward is about 18° from vertical.

* * * * *